US005957536A

United States Patent [19]

Sullivan

[11] Patent Number: 5,957,536

[45] Date of Patent: Sep. 28, 1999

[54] FURNITURE SEATS

[76] Inventor: Mike Sullivan, 13285 Rebel Rd., Theodore, Ala. 36852

[21] Appl. No.: 09/067,027

[22] Filed: Apr. 28, 1998

[51] Int. Cl.[6] ..... A47C 7/02

[52] U.S. Cl. ..... 297/452.2; 297/452.63; 297/280

[58] Field of Search ..... 297/452.19, 452.2, 297/452.63, 281, 273, 280; 472/118, 125

[56] References Cited

U.S. PATENT DOCUMENTS

| | | | |
|---|---|---|---|
| 872,736 | 12/1907 | Lansberry, Jr. | 297/273 X |
| 1,266,129 | 5/1918 | Killman | 297/281 X |
| 2,470,525 | 5/1949 | Schultheis | 297/452.2 |
| 5,667,273 | 9/1997 | Noll | 297/273 X |

*Primary Examiner*—Milton Nelson, Jr.

*Attorney, Agent, or Firm*—Nixon & Vanderhye P.C.

[57] ABSTRACT

Furniture seats have forward, rearward and intermediate horizontal support conduits extending parallel with respect to one another in a lengthwise direction of the seat. The forward and rearward horizontal support conduits include a plurality of blind holes, while the intermediate horizontal support conduit includes plural pairs of through holes. A number of generally L-shaped one-piece decking support conduits have their forward and rearward ends inserted into respective ones of the blind holes of the forward and rearward horizontal support conduits. A region between such forward and rearward ends is inserted into a respective pair of through holes of the intermediate horizontal support conduit so that the horizontal support conduit is sleeved thereover. A plurality of parallel decking structures (preferably smaller-diameter conduits) are attached to said L-shaped decking support conduits so as to form a surface to support a person in a seated position.

13 Claims, 6 Drawing Sheets

FURNITURE SEATS

FIELD OF THE INVENTION

The present invention generally relates to the field of furniture. More particularly the present invention relates to indoor and outdoor furniture formed of tubular component structures. In preferred forms, the present invention is embodied in furniture seats constructed of tubular thermoplastic piping sections.

BACKGROUND AND SUMMARY OF THE INVENTION

The art of furniture design and construction is quite varied. In this regard, a number of prior proposals for furniture design exist in the art as evidenced by the following non-exhaustive list of prior-issued U.S. Patents (the entire content of each being expressly incorporated hereinto by reference):

| U.S. Pat. No. | Patentee | Issue Date |
|---|---|---|
| 3,180,663 | Lehmann | Apr. 27, 1965 |
| 3,653,697 | Ernst | Apr. 4, 1972 |
| 4,063,836 | Militano | Dec. 20, 1977 |
| 3,921,960 | Bright | Nov. 25, 1975 |
| 3,730,601 | Misenheimer, III | May 1, 1973 |
| 3,719,389 | Burton et al | march 5, 1973 |
| 5,169,258 | Raynak | Dec. 8, 1992 |
| 4,761,093 | Seymour | Aug 2, 1988 |
| 4,692,055 | Seymour | Sep. 8, 1987 |
| 5,067,842 | Ponting | Nov. 26, 1991 |
| 4,958,425 | Gomes | Sep. 25, 1990 |
| 4,706,573 | Sielaff | Nov. 17, 1987 |
| 3,932,048 | DuPont | Jan. 13, 1976 |
| 5,083,390 | Edman | Jan. 28, 1992 |

While the prior art furniture designs are satisfactory for their respective intended purposes, some improvements would be desirable. For example, it would be desirable if furniture could be constructed from segments of thermoplastic tubular piping which was both structurally sound and aesthetically pleasing. It is toward providing such furniture that the present invention is directed.

Broadly, the present invention is embodied in the structural and aesthetic arrangement of segments of conventional thermoplastic piping to form useful furniture seats. More specifically, the present invention is embodied in furniture seats having forward, rearward and intermediate horizontal support conduits extending parallel with respect to one another in a lengthwise direction of the seat. The forward and rearward horizontal support conduits include a plurality of blind holes, while the intermediate horizontal support conduit includes plural pairs of through holes. A number of generally L-shaped one-piece decking support conduits have their forward and rearward ends inserted into respective ones of the blind holes of the forward and rearward horizontal support conduits. A region between such forward and rearward ends is inserted into a respective pair of through holes of the intermediate horizontal support conduit so that the horizontal support conduit is sleeved thereover. A plurality of parallel decking structures (preferably smaller-diameter conduits) are attached to said L-shaped decking support conduits so as to form a surface to support a person in a seated position.

These and other aspects and advantages of the present invention will become more clear after careful consideration is given to the following detailed description of the preferred exemplary embodiment thereof.

BRIEF DESCRIPTION OF THE ACCOMPANYING DRAWINGS

Reference will be made hereinafter to the accompanying drawings, wherein like reference numerals through the various FIGURES denote like structural elements, and wherein.

DETAILED DESCRIPTION OF THE INVENTION

Figure 1:
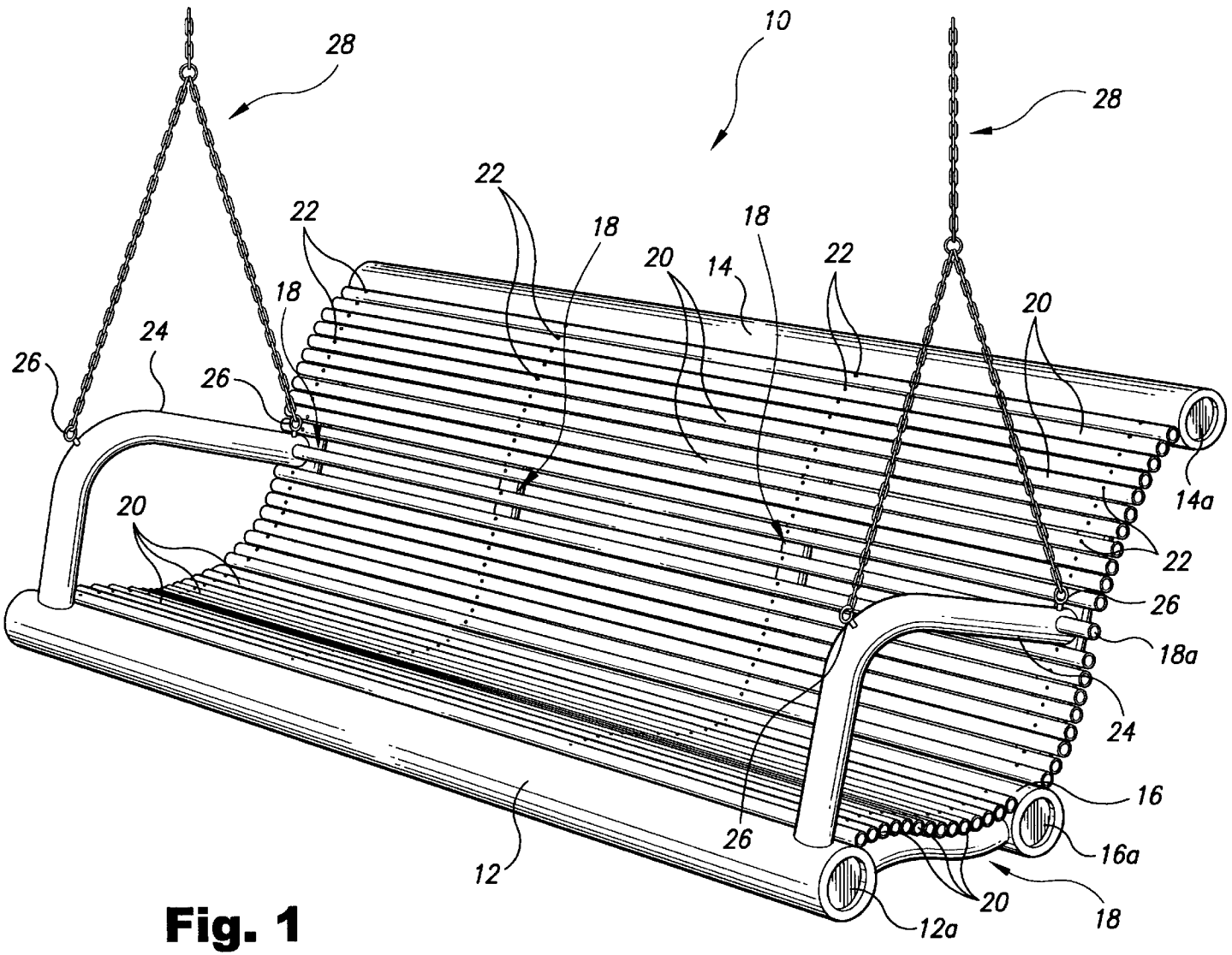
FIG. 1 is a frontal perspective view of one possible furniture design embodying the present invention.
Figure 2:
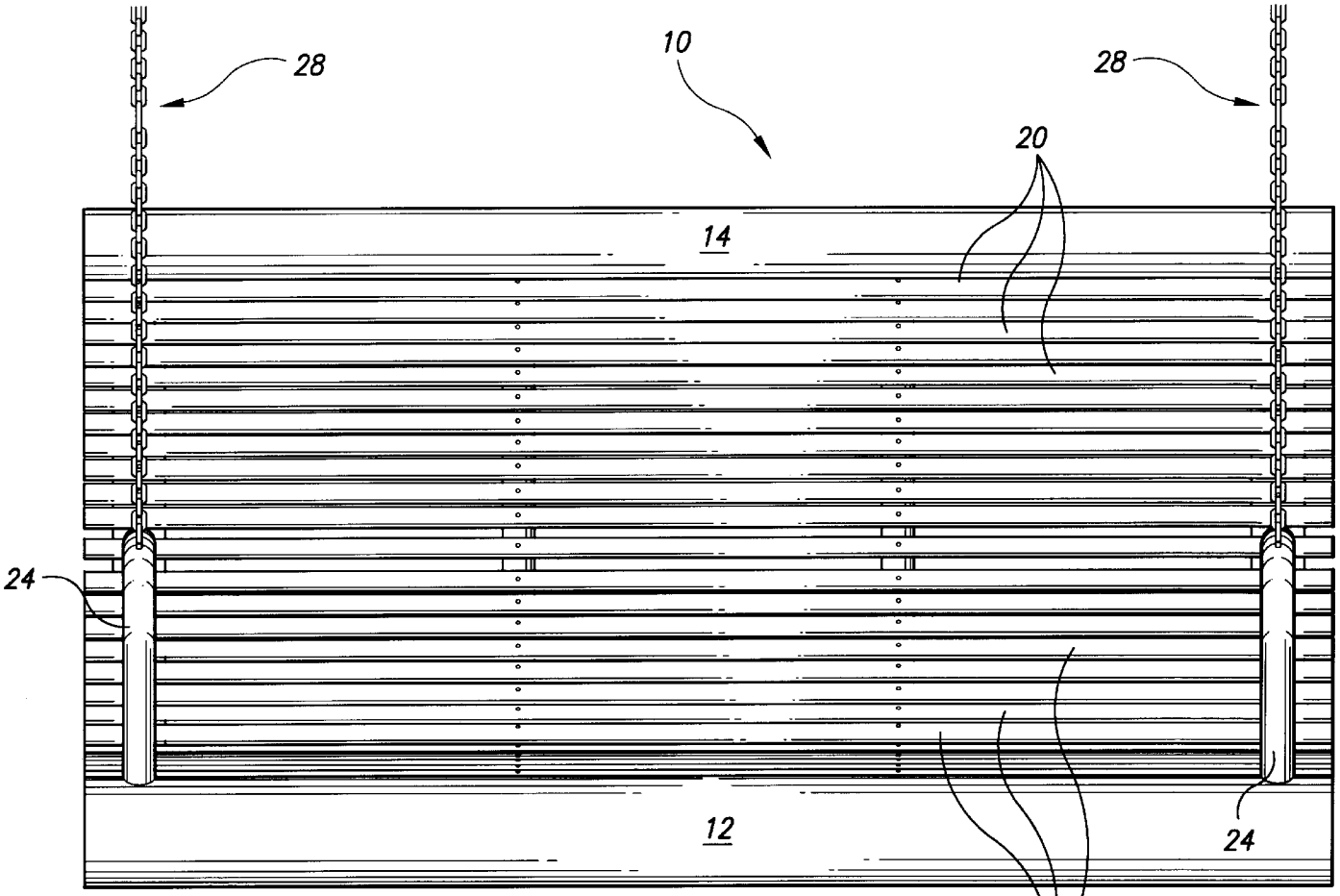
FIG. 2 is a front elevational view thereof.
Figure 3:
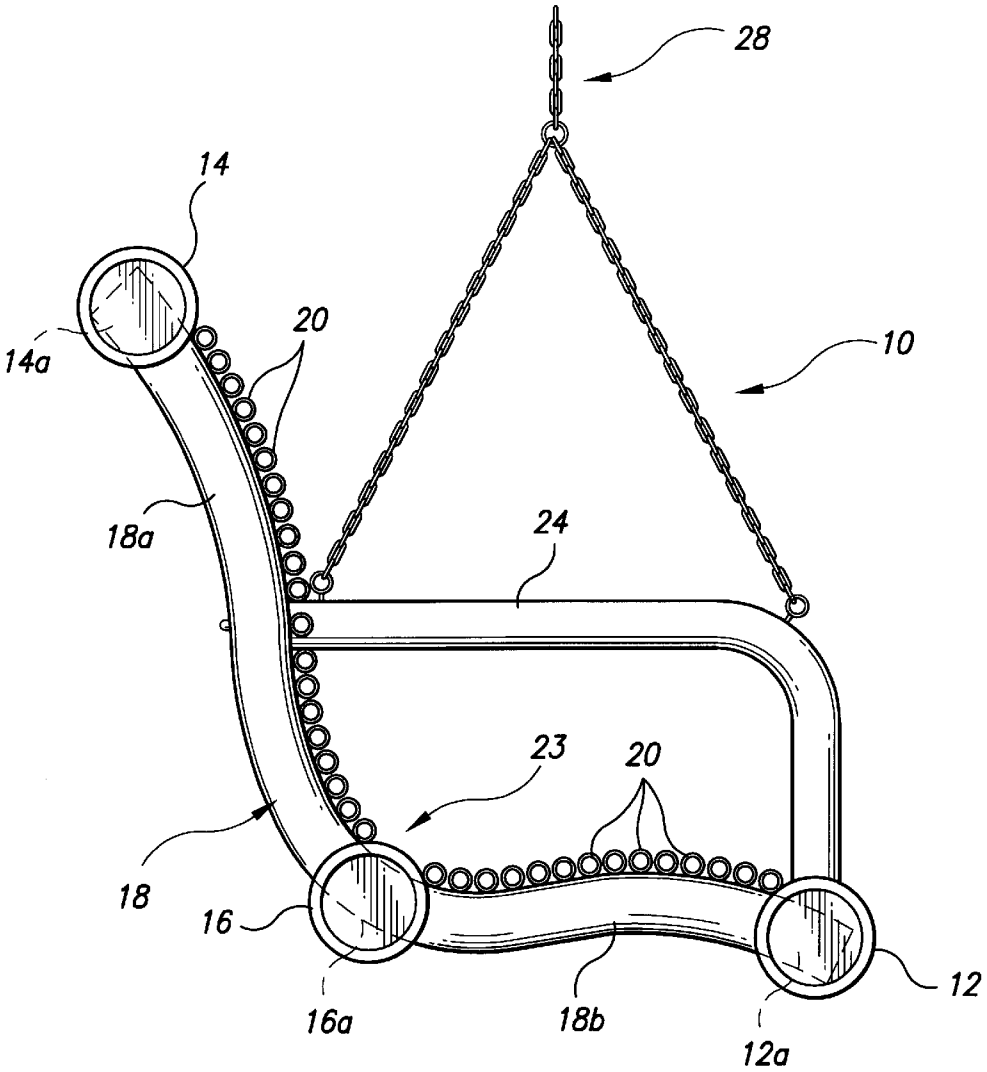
FIG. 3 is a right side elevational view thereof, the left side elevational view being a mirror image thereof.
Figure 4:
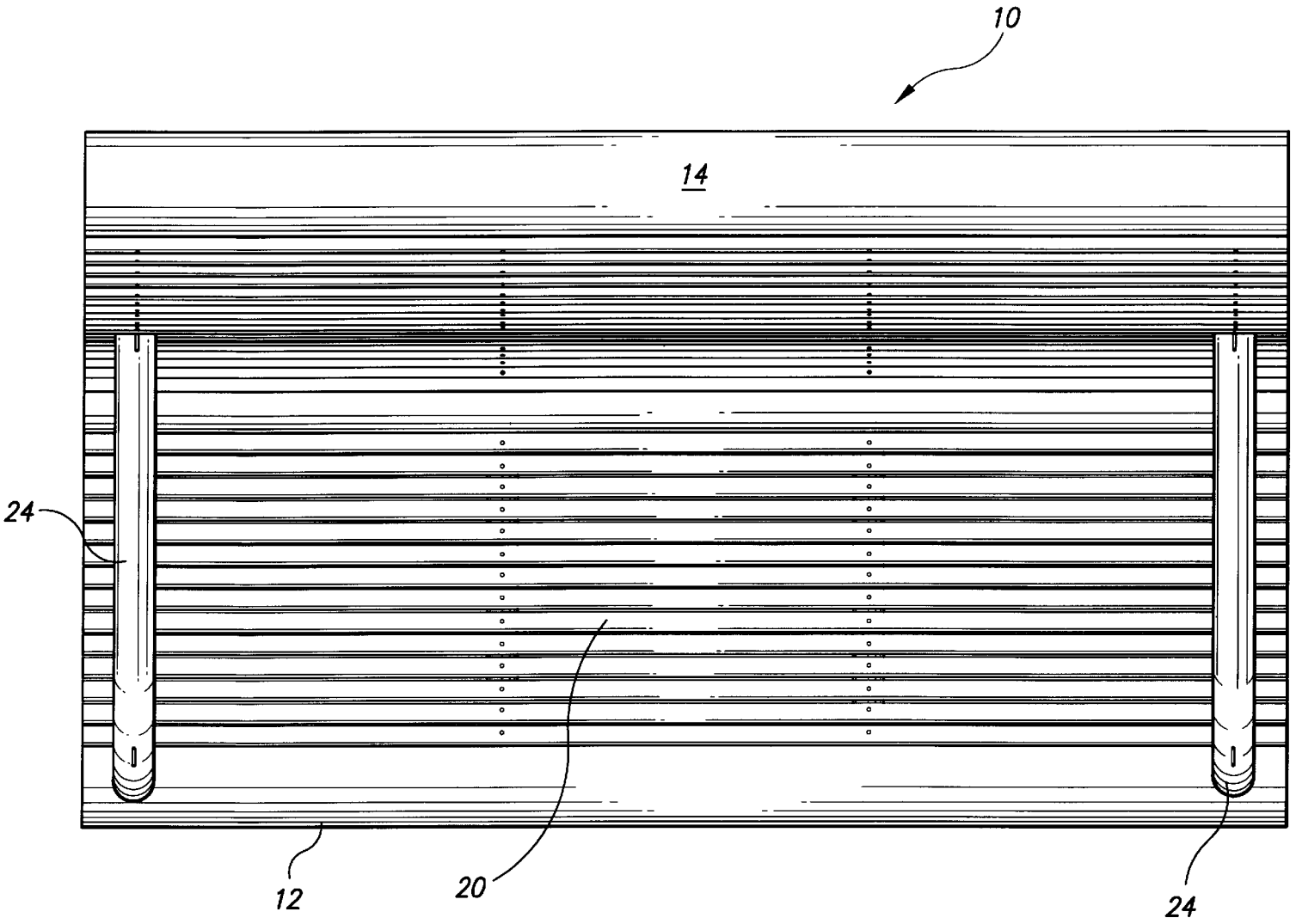
FIG. 4 is a top plan view thereof.
Figure 5:
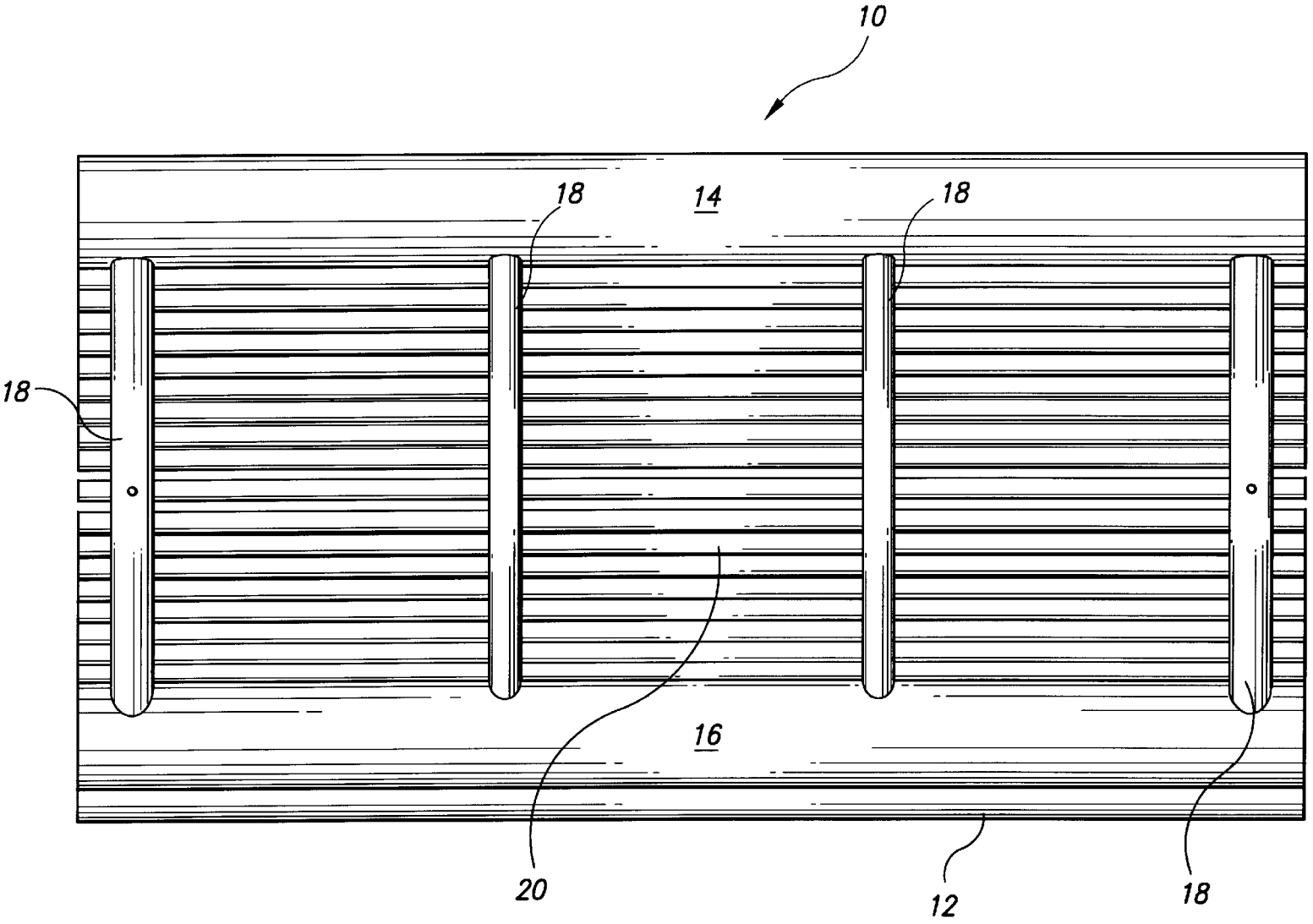
FIG. 5 is a rear elevational view thereof.
Figure 6:
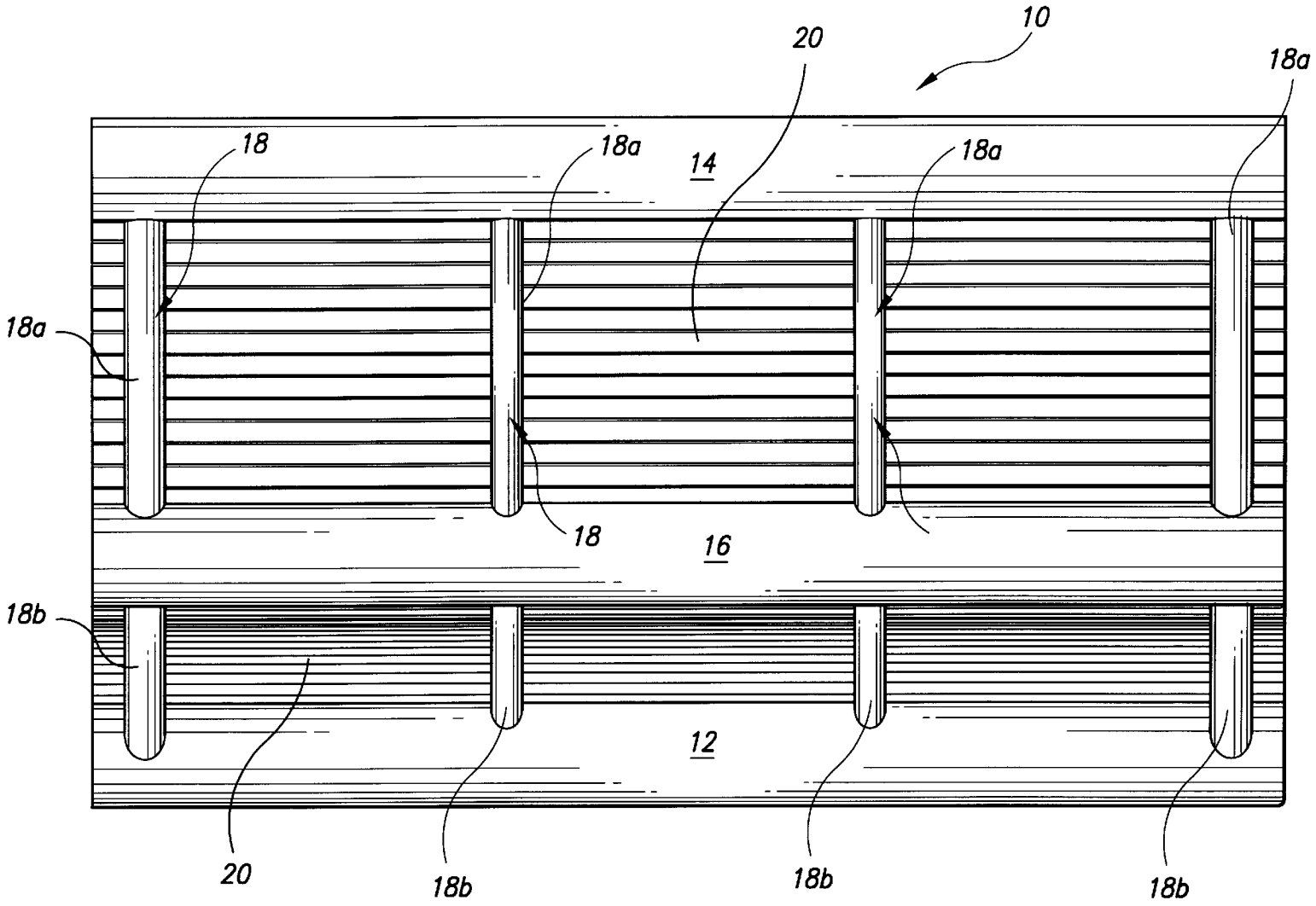
FIG. 6 is a bottom plan view thereof.

Accompanying FIGS. 1–6 depict a particularly preferred embodiment of the present invention. In this regard, the embodiment of the invention depicted in FIGS. 1–6 is in the form of an outdoor bench-type swing 10, commonly known as a "porch swing". It will be appreciated, however, that other forms of chairs, chaise lounges, stand-alone benches, and other like furniture seat structures can be made using the tenants of the present invention. Thus, while reference will hereinafter be made to the porch swing 10 depicted in the accompanying drawing FIGURES, it will be understood that such reference is to a preferred embodiment of the present invention and is non-limiting thereto.

The porch swing 10 includes three parallel, horizontal support pipes including a forward horizontal support conduit 12, a rearward horizontal support conduit 14, and an intermediate horizontal support conduit 16 extending substantially the entire lengthwise (longitudinal) direction of the porch swing 10. Each of the conduits 12, 14 and 16 is capped at its ends with an appropriately sized flush end cover 12*a,* 14*a,* and 16*a,* respectively.

Multiple L-shaped deck support conduits 18 are spaced apart from one another in the lengthwise (longitudinal) direction of the swing 10. A dense plurality of closely spaced-apart decking conduits (a few of which are identified in the accompanying drawing FIGURES by reference numeral 20) are fixedly secured to the deck support pipes 18 in any convenient manner, for example, by self-tapping screws, bolts or the like (a few of which are identified in FIG. 1 by reference numeral 22).

Each of the L-shaped decking support conduits 18 is of a one piece hollow pipe structure having a forward end fixedly received within a blind hole formed in the forward support conduit 12 and rearward end fixedly received within a blind hole of the rearward support conduit 14. The decking support conduits 18 include an arcuate bend region 23 in the vicinity of their coupling to the intermediate support conduit 16 so as to establish a generally upright vertically disposed leg section 18*a,* and a generally horizontally disposed leg section 18*b* (see FIG. 3, for example). The sections 18*a,* 18*b* form an angle that is greater than about 90° therebetween. Each of the leg sections 18*a,* 18*b* are, moreover, provided with a slight S-curve so as to form an apex of the decking conduits 20 substantially midway between each of the forward and rearward support conduits 12, 14 on the one hand, and the intermediate support conduit 16 on the other hand. These slight S-curves and the apexes of the decking conduits 20 formed thereby improve the comfort of the bench when a person is seated thereon.

The intermediate horizontal support conduit 16 includes axially offset pairs of holes corresponding in number to the number of decking support conduits 18 employed. These pairs of axially offset pairs of holes thereby establish the angular orientation of the legs 18*a,* 18*b* with respect to one another. The intermediate one-piece (unitary) decking support conduit 18 is therefore capable of being sleeved onto the decking support conduits 18 by inserting the latter into and through a respective pair of offset holes formed in the former.

One-piece (unitary) L-shaped arm rests 24 are provided having A forward ends fixedly inserted into a blind hole formed in the forward horizontal support conduit 12 and a rearward end fixedly inserted into an upright leg section 18*a* of respective end-most decking support conduits 18. In this regard, it will be observed that one of the decking conduits (identified by reference numeral 18*a*) is inserted entirely through a concentrically aligned pair of holes formed in the arm rests 24 so as to present a visually pleasing union therebetween. The arm rests carry eye-bolts 26 to which supporting chain, rope, cable or the like 28 may be attached for securing the entire porch swing 10 to overhead support structures (not shown) thereby allowing users to swing to and fro while seated thereon.

The structural conduit components of the porch swing 10 as described above are most preferably formed of conventional polyvinyl chloride (PVC) piping. This piping may be white or may be colored as may be desired (e.g., by compounding colorants with the PVC piping before extrusion) or by painting the PVC piping post-extrusion. As may be appreciated from the discussion above, the horizontal support conduits 12, 14 and 16 are each of larger diameter as compared to the diameters of the decking support conduits 18, decking conduits 20 and arm rests 24. In this regard, it is preferred that the nominal diameters of each of the decking support conduits 18 be less than about 70% of the nominal diameters of the horizontal support conduits 12, 14 and 16, while the nominal diameters of the arm rests 24 are most preferably less than about 50% of the nominal diameters of the horizontal support conduits 12, 14 and 16. The decking conduits 20 are most preferably the smallest-diameter PVC conduits employed and typically will have nominal diameters which are less than about 20% of the nominal diameters of the horizontal support conduits 12, 14 and 16. In one particularly preferred embodiment of this invention, the horizontal support conduits 12, 14 and 16 are each about 3" nominal diameter Sch. 40 PVC pipe, the decking support conduits 18 are each about 2" Sch. 40 PVC pipe, the decking conduits 20 are about ½" Sch. 40 PVC pipe, and the arm rests are about 1½" PVC pipe.

The unitary PVC conduits may be shaped as desired by heating a desired section of the conduit to its softening point, followed by bending the heat-softened PVC into the desired shape using a bending jig. In such a manner, the PVC conduits can be purchased in linear lengths and then fabricated into the component structures discussed above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A furniture seat comprising:

forward, rearward and intermediate horizontal support conduits extending parallel with respect to one another in a lengthwise direction;

said forward and rearward horizontal support conduits including a plurality of blind holes, and said intermediate horizontal support conduit including plural pairs of through holes;

a number of generally L-shaped one-piece decking support conduits having forward and rearward ends inserted into respective ones of said blind holes of said forward and rearward horizontal support conduits, and having a region therebetween which is inserted into a respective pair of through holes of said intermediate horizontal support conduit so that said intermediate horizontal support conduit is sleeved thereover; and a plurality of parallel decking structures attached to said L-shaped decking support conduits.

2. The seat of claim 1, wherein said L-shaped decking support conduits have a nominal diameter that is less than about 70% of a respective nominal diameter of any one of said forward, rearward and intermediate horizontal support conduits.

3. The seat of claim 1, wherein said forward, rearward and intermediate horizontal support conduits are capped at each end thereof with flush end-caps.

4. The seat of claim 1, in the form of a porch swing.

5. The seat of claim 1 wherein said decking structures are decking conduits.

6. The seat of claim 5, wherein said decking conduits have an nominal diameter that is less than about 20% of a respective nominal diameter of any one of said forward, rearward and intermediate horizontal support conduits.

7. The seat as in claim 1, further comprising L-shaped arm rests having one end fixedly inserted into said forward horizontal conduit, and a rearward end fixedly inserted into a respective one of said decking support conduits.

8. The seat as in claim 7, wherein said arm rests are L-shaped arm rest conduits.

9. The seat of claim 8, wherein said L-shaped arm rest conduits have a nominal diameter that is less than about 50% of a respective nominal diameter of any one of said forward, rearward and intermediate horizontal support conduits.

10. The seat of claim 1, wherein said L-shaped decking support conduits are bent so as to form a generally upright leg section and a generally horizontally disposed leg section.

11. The seat of claim 10, wherein at least one of said generally upright and horizontally disposed leg sections is slightly S-curved.

12. The seat of claim 10, wherein each of said generally upright and horizontally disposed leg sections are slightly S-curved.

13. The seat of claim 10, wherein said generally upright and horizontally disposed leg sections are oriented at an angle greater than 90° relative to one another.

* * * * *